US011013376B2

(12) United States Patent
Yoo et al.

(10) Patent No.: US 11,013,376 B2
(45) Date of Patent: May 25, 2021

(54) DRYING MACHINE

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 67 days.

(21) Appl. No.: 16/576,431

(22) Filed: Sep. 19, 2019

(65) Prior Publication Data

US 2020/0085258 A1 Mar. 19, 2020

Related U.S. Application Data

(60) Provisional application No. 62/733,478, filed on Sep. 19, 2018.

(30) Foreign Application Priority Data

Feb. 25, 2019 (KR) ..... 10-2019-0022025
Jul. 22, 2019 (KR) ..... 10-2019-0088429

(51) Int. Cl.
*A47K 10/48* (2006.01)
*A45D 20/12* (2006.01)
*A45D 20/14* (2006.01)

(52) U.S. Cl.
CPC ..... *A47K 10/48* (2013.01); *A45D 20/12* (2013.01); *A45D 20/14* (2013.01); *A45D 2020/128* (2013.01)

(58) Field of Classification Search
CPC ..... A47K 10/48; A45D 20/12; A45D 20/14; A45D 2020/128
(Continued)

(56) References Cited

U.S. PATENT DOCUMENTS 3,828,430 A * 8/1974 Yamada ..... B26B 19/44 30/41.5
4,219,178 A * 8/1980 Assion ..... A45D 20/12 211/89.01
(Continued)

FOREIGN PATENT DOCUMENTS

DE 3429319 A1 2/1986
EP 3626108 A1 * 3/2020 ..... A47K 10/48
(Continued)

*Primary Examiner* — Stephen M Gravini
(74) *Attorney, Agent, or Firm* — Birch, Stewart, Kolasch & Birch, LLP

(57) ABSTRACT

A drying machine includes a dryer and a stand. The dryer includes a casing having a front opening, a grip including a cylindrical grip body downwardly extended from the casing, and a lower cover covering a lower opening part of the grip body. The stand includes a hollow portion matched up with the grip, and a seating unit in which the dryer is rotatably seated. The grip includes a first electrical terminal positioned in the grip body and a second electrical terminal positioned in the lower cover. The seating unit includes a first contact terminal positioned in the hollow portion and electrically connected to the first electrical terminal, and a second contact terminal positioned in the hollow portion and electrically connected to the second electrical terminal. The first and second contact terminals maintain an electrical connection with the first and second electrical terminals regardless of the rotation of the dryer.

20 Claims, 9 Drawing Sheets

(58) Field of Classification Search
USPC ..... 34/95–100
See application file for complete search history.

(56) References Cited

U.S. PATENT DOCUMENTS

| | | | | |
|---|---|---|---|---|
| 4,910,385 | A * | 3/1990 | Shye-Long | A45D 20/12 200/332.2 |
| 5,174,531 | A * | 12/1992 | Perakis | A45D 20/12 248/124.1 |
| 5,873,178 | A * | 2/1999 | Johnson | A47K 10/48 34/90 |
| 6,491,267 | B1 | 12/2002 | Feldman | |
| 6,505,369 | B1 * | 1/2003 | Weinmann | D06F 34/18 8/159 |
| 6,997,421 | B2 * | 2/2006 | Reynolds | A45D 20/12 248/117.2 |
| 9,149,105 | B2 * | 10/2015 | Yoe | A45D 20/12 |
| 10,660,487 | B1 * | 5/2020 | Borja | A47K 10/48 |
| 2020/0085250 | A1 * | 3/2020 | Youn | A01K 13/001 |
| 2020/0085251 | A1 * | 3/2020 | Youn | A47K 10/48 |
| 2020/0085255 | A1 * | 3/2020 | Yoo | F16M 11/2014 |
| 2020/0085257 | A1 * | 3/2020 | Yoo | A45D 20/12 |
| 2020/0085258 | A1 * | 3/2020 | Yoo | A45D 20/14 |
| 2020/0085259 | A1 * | 3/2020 | Yoo | A45D 20/12 |
| 2020/0085262 | A1 * | 3/2020 | Youn | A45D 20/12 |
| 2020/0315313 | A1 * | 10/2020 | Friedman | H01M 10/613 |
| 2020/0405039 | A1 * | 12/2020 | Jung | A45D 44/00 |

FOREIGN PATENT DOCUMENTS

| | | | | |
|---|---|---|---|---|
| EP | 3626111 | A1 * | 3/2020 | A45D 20/12 |
| EP | 3626117 | A1 * | 3/2020 | F16M 11/2014 |
| KR | 10-2019-0072169 | A | 6/2019 | |
| WO | WO 99/01049 | A1 | 1/1999 | |
| WO | WO 01/54536 | A1 | 8/2001 | |

* cited by examiner

DRYING MACHINE

CROSS REFERENCE TO RELATED APPLICATIONS

This application claims the priority benefit of U.S. Provisional Application No. 62/733,478, filed on Sep. 19, 2018, Korean Patent Application No. 10-2019-0022025, filed on Feb. 25, 2019, and Korean Patent Application No. 10-2019-0088429, filed on Jul. 22, 2019, the entire disclosures of all of which are hereby expressly incorporated by reference into the present application.

BACKGROUND OF THE DISCLOSURE

Field of the Disclosure

The present disclosure relates to a drying machine for drying a given object by blowing heated air. More particularly, the present disclosure relates to a drying machine in which a dryer is rotatably held in a stand, and the contact terminals of the stand and the electrical terminals of the dryer are electrically connected.

Description of the Related Art

In order to use a dryer for a long time and to effectively dry a drying target without fatigue of an arm or hand, it may be necessary to place the dryer in a stand, and it may be necessary for the dryer to be smoothly rotated while the dryer is located in the stand.

Furthermore, power needs to be stably supplied to the dryer even though the dryer may be rotated while located in the stand.

KR 10-2017-0173308 discloses a wireless hair dryer having a charging battery embedded therein, and a charger.

Specifically, the charging battery is positioned in a handle, and the charging terminal of the charging battery is positioned at the bottom of the handle.

The charger includes a ground terminal brought into contact with the charging terminal, and may charge the wireless hair dryer by the coupling of the wireless hair dryer and the charger.

However, the wireless hair dryer cannot be independently rotated in view of the coupling structure of the wireless hair dryer and the charger in the state in which the dryer has been coupled to the charger.

Accordingly, in order to perform drying for a long time or to perform drying without fatigue of the human body, the disclosed configuration is inconvenient because a drying direction has to be controlled by moving the coupled wireless hair dryer and charger together.

Furthermore, the structure of the handle and the charger, the charging terminal, and the ground terminal have directivity. Accordingly, in order for the wireless hair dryer to be coupled to the charger for charging purposes, there is a structural restriction because the wireless hair dryer must satisfy a specific location and a specific direction with respect to the charger.

That is, the charger cannot be smoothly coupled to the wireless hair dryer if the outlet of the wireless hair dryer deviates from a specific direction or the wireless hair dryer is inclined toward a location other than a specific location.

Accordingly, a person with poor eyesight or having a bad field of view may have difficulty coupling the wireless hair dryer to the charger.

SUMMARY OF THE DISCLOSURE

The present disclosure provides a drying machine in which a stand structure can be stably maintained, and a dryer can be rotated without restriction while been held in the stand.

In addition, the present disclosure provides a drying machine in which power can be stably supplied to a dryer even if the dryer is rotated while been held in the stand.

Also, the present disclosure provides a drying machine in which a dryer can be easily held in a stand and charged regardless of the insertion direction and insertion location of the dryer.

The objects of the present disclosure are not limited to the above-described objects, and the other objects will be understood by those skilled in the art from the following description.

In one aspect, a drying machine enables a dryer to be easily held in a stand, and enables the smooth rotation of the held dryer by controlling the grip of the dryer and the seating unit shape of the stand.

Furthermore, the drying machine enables stable power supply between the dryer and the stand by controlling the structure of the electrical terminals of the grip and the contact terminals of the seating unit.

Specifically, the dryer includes the grip, including a cylindrical grip body extended downward from a casing having a front opening and a lower cover covering the lower opening part of the grip body.

The stand includes a hollow portion mated with the grip, and includes the seating unit in which at least part of the grip is inserted into the top opening of a hollow portion, and the dryer is rotatably seated.

The grip includes a first electrical terminal positioned in the grip body and a second electrical terminal positioned in the lower cover.

The seating unit includes a first contact terminal positioned in the hollow portion and electrically connected to the first electrical terminal, and a second contact terminal electrically connected to the second electrical terminal.

The first and second contact terminals maintain an electrical connection with the first and second electrical terminals regardless of the rotation of the dryer.

The stand further includes a barrel-shaped stand housing. The seating unit may be positioned in the top opening of the stand housing.

The seating unit may include a guide unit, a sidewall and a bottom cover.

The guide unit has a ring shape, and may have an opening formed therein.

The sidewall is a cylindrical shape, and may be extended downward from the inside edge of the guide unit.

The bottom cover may cover the lower opening part of the sidewall.

The grip may be inserted into the opening.

The internal diameter of the sidewall may be the same as the external diameter of the grip body.

The diameter of the opening of the guide unit may be increased from bottom to top.

The first electrical terminal may be positioned on the outer circumference surface of the grip body in a ring shape.

The second electrical terminal may be positioned at the bottom center of the lower cover and may be concave inward. The lateral section of the second electrical terminal may be a circle.

The first contact terminal may be positioned on the inner circumference surface of the sidewall in accordance with the first electrical terminal in a ring shape.

The second contact terminal may be positioned at the top of the bottom cover in accordance with the second electrical terminal, and may be convex upward in such a way as to be mated with the second electrical terminal.

The lower cover may be a downward convex hemispheric type.

The bottom cover may be an inward concave hemispheric type in such a way as to be mated with the lower cover.

In another aspect of the present disclosure, the drying machine may modify the structure of the electrical terminal of the grip and the contact terminal of the seating unit.

Specifically, the first electrical terminal is positioned on the outer circumference surface of the grip body in a ring shape.

The second electrical terminal is positioned at the bottom center of the lower cover and is concave inward.

The first contact terminal is extended from the inner side of the hollow portion toward the inner side of the hollow portion and protruded, and is electrically connected to the first electrical terminal.

The second contact terminal is positioned at the center of the inside bottom surface of the hollow portion, convex upward, and electrically connected to the second electrical terminal.

The first contact terminal may include a first protruded electrode extended from the inner side of the sidewall in a first direction that forms an acute angle along with the inner side of the sidewall.

Furthermore, the first contact terminal may include a second protruded electrode extended from one end of the first protruded electrode toward the inner side of the sidewall in a second direction that forms an acute angle along with the inner side of the sidewall.

The first contact terminal may include a conductive material whose shape is elastic.

The second contact terminal may be positioned at the center of the top of the bottom cover in accordance with the second electrical terminal.

Furthermore, the second contact terminal is convex upward in such a way as to be mated with the second electrical terminal. The lateral section of the second contact terminal may be a circle.

In another aspect of the present disclosure, the drying machine may modify the structure of the electrical terminal of the grip and the contact terminal of the seating unit.

Specifically, the first electrical terminal and the second electrical terminal are spaced apart in a ring shape and parallel, and are positioned on the outer circumference surface of the grip body.

The first contact terminal electrically connected to the first electrical terminal and the second contact terminal electrically connected to the second electrical terminal are spaced apart, and are extended and protrude from the inner side of the hollow portion to the inner side of the hollow portion.

Each of the first contact terminal and the second contact terminal may include a first protruded electrode extended from the inner side of the sidewall in a first direction that forms an acute angle along with the inner side of the sidewall.

Furthermore, each of the first contact terminal and the second contact terminal may include a second protruded electrode extended from one end of the first protruded electrode toward the inner side of the sidewall in a second direction that forms an acute angle along with the inner side of the sidewall.

In another aspect of the present disclosure, the drying machine may modify the structure of the electrical terminal of the grip and the contact terminal of the seating unit.

The first electrical terminal is positioned at the bottom of the lower cover in a circular ring shape.

The second electrical terminal is spaced apart from the first electrical terminal at the bottom of the lower cover and surrounds the first electrical terminal in a circular ring shape.

The first contact terminal electrically connected to the first electrical terminal and the second contact terminal electrically connected to the second electrical terminal are extended and protruded upward from the inside bottom surface of the hollow portion.

Each of the first contact terminal and the second contact terminal includes a curved part, and may be extended upward from the inside bottom surface.

The first contact terminal may correspond to at least part of the first electrical terminal, and the second contact terminal may correspond to at least part of the second electrical terminal.

The seating unit may include a cylindrical first barrier positioned on the inside bottom surface and a cylindrical second barrier positioned on the first barrier.

The second contact terminal may be positioned between the first barrier and the second barrier, and the first contact terminal may be positioned within the second barrier.

In another aspect of the present disclosure, the drying machine may modify the structure of the electrical terminal of the grip and the contact terminal of the seating unit.

The first electrical terminal is positioned at the bottom of the lower cover in a circular ring shape.

The second electrical terminal is positioned at the bottom center of the lower cover, concave inward, and has a circular lateral section.

The first contact terminal electrically connected to the first electrical terminal is positioned on the inside bottom surface of the hollow portion, and has a circular ring shape.

The second contact terminal electrically connected to the second electrical terminal is positioned on the inside bottom surface, and is convex upward in such a way as to be mated with the second electrical terminal.

The means for solving problems that are not described above may be sufficiently derived from a description of an embodiment of the present disclosure.

DESCRIPTION OF EXEMPLARY EMBODIMENTS

Figure 1:
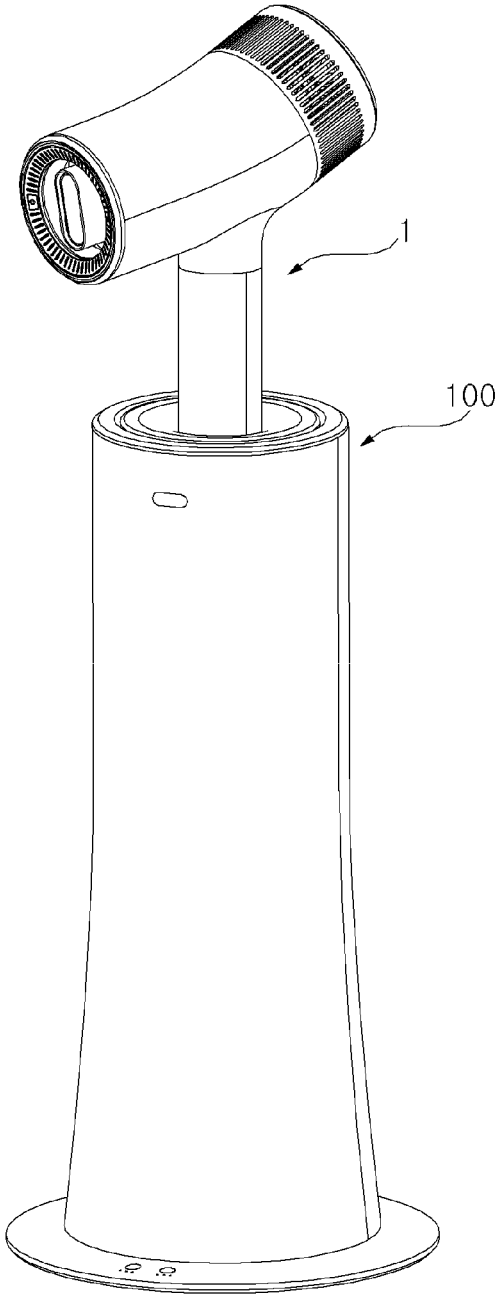
FIG. 1 is a perspective view of a drying machine according to an embodiment of the present disclosure.

The advantages and features of the present disclosure and a method of achieving them will become apparent with reference to the embodiments described in detail below together with the accompanying drawings. However, the present disclosure is not limited to the embodiments set forth herein but may be embodied in many different forms, and these embodiments are provided so that the disclosure of the present disclosure is complete and that those skilled in the art will fully understand the scope of the present disclosure, and the present disclosure is only defined by the scope of the claims. Like reference numerals designate like elements throughout the specification.

A drying machine according to an embodiment of the present disclosure is described with reference to the accompanying drawings.

Figure 2:
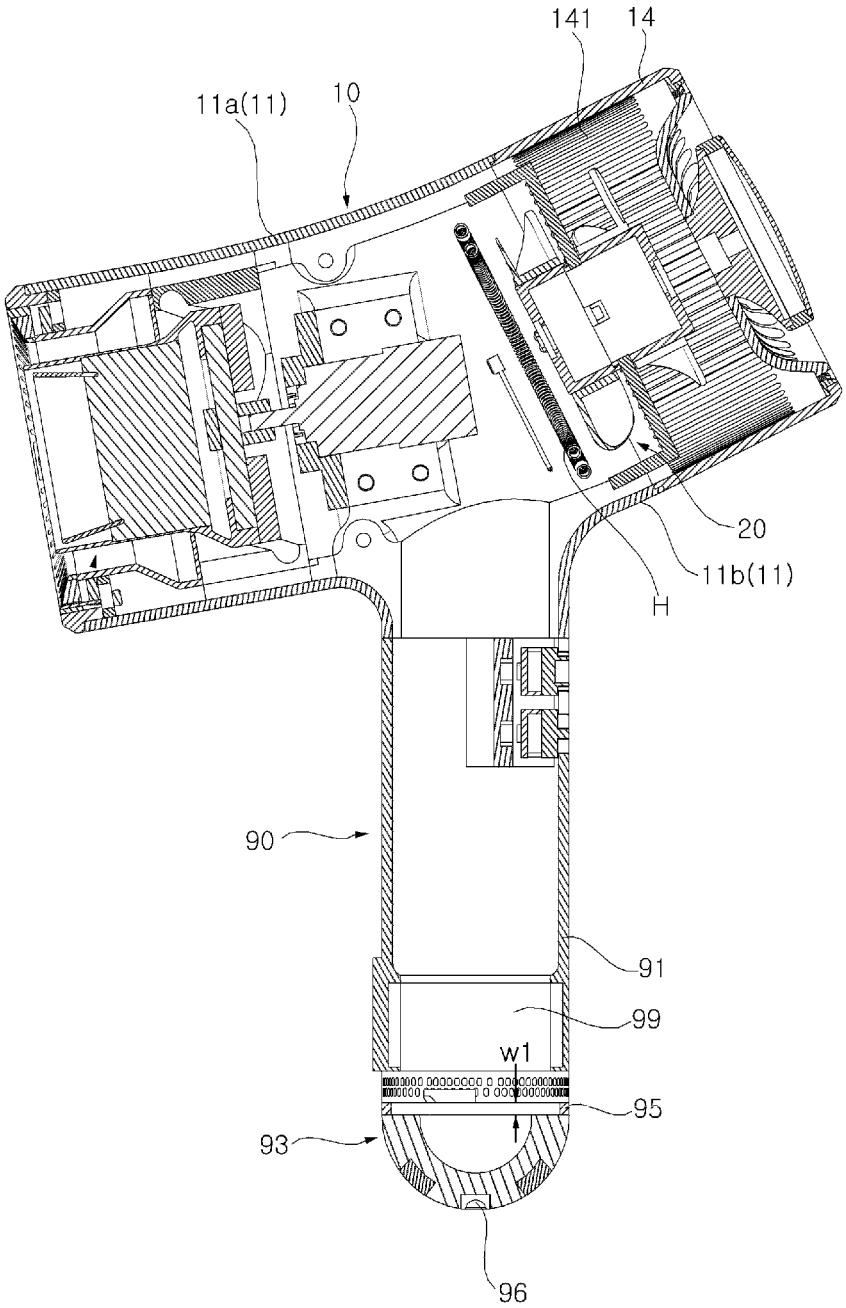
FIG. 2 is a longitudinal cross-sectional view of a dryer shown in FIG. 1.

Referring to FIGS. 1 and 2, the drying machine according to an embodiment of the present disclosure includes a dryer 1. The dryer 1 includes a fan 20 configured to receive external air and blow the air, and a heater H configured to heat the blown air.

Furthermore, the drying machine includes a stand 100 in which the dryer 1 is held, and which enables drying without the need for a user to directly grasp the dryer 1.

That is, in the drying machine according to an embodiment of the present disclosure, the dryer 1 is held in the stand 100 and can perform drying. In addition, although drying may be performed for a long time, there is no burden on a user because the two hands of the user are free. Also, an object can be effectively dried.

The dryer 1 according to an embodiment of the present disclosure is described in detail with reference to FIG. 2.

The dryer 1 includes a hollow casing 10. The fan 20 is configured to force external air to flow into the casing 10 and to blow the air out of the casing 10. The heater H is positioned downstream of the fan 20 and is configured to heat the air.

More specifically, the casing 10 may include a casing body 11 in which an upper casing 11*a* and a lower casing 11*b* are integrated to form a cylindrical tube having an open front.

Furthermore, the casing 10 may include a cylindrical cap 14 connected to the back of the casing body 11. The cylindrical cap 14 includes a plurality of through holes 141 for receiving external air.

That is, air received through the through holes 141 moves to an opening at the front of the dryer 1 through the casing body 11.

"Couple" or "connect" or "derivatives thereof" described above or to be described later means that two or more elements are integrated or assembled according to a known connection method, such as fusion, adhesion, forced insertion, screw coupling, bolt fastening, or a key connection.

The ventilation fan 20 is received in the casing 10, and forces external air to flow into the casing 10 and simultaneously blows air to the front opening of the casing 10 as described above.

The heater H is positioned downstream of the fan 20, and may be configured with a ring-shaped coil heater to heat air blown by the fan 20.

However, the arrangement structure of the fan 20 and the heater H is not limited to above description and as shown in the drawing, and may include a range which can be easily designed and changed by those skilled in the art.

The dryer 1 according to an embodiment of the present disclosure may include a battery 99 capable of autonomously transmitting power to the fan 20 and the heater H.

Accordingly, the dryer 1 according to an embodiment of the present disclosure can maximize utilization without being limited to a use area of the dryer 1 because drying can be performed without external power being supplied.

The dryer 1 may include a grip 90 coupled to the lower side of the casing 10.

Specifically, the grip 90 may include a grip body 91 having a cylindrical shape, and a lower cover 93 covering the lower opening part of the grip body 91. A heat dissipating cap 94 (FIG. 5) may be interposed between the grip body 91 and the lower cover 93.

The grip body 91 has a cylindrical shape and may be a portion by which a user directly holds the dryer 1 while performing drying.

In this specification, the cylindrical shape does not mean only a geometric right circular cylindrical shape, or a shape without any curve or unevenness formed in the outer surface of the grip body 91.

Instead, the cylindrical shape may include a shape without an irregular corner or a protruded portion, for example, that would provide the outer surface of the grip body 91 with directivity.

Furthermore, at least part of the grip body 91 may have a cylindrical shape.

That is, the grip body 91 may be fully a cylindrical shape, or only a part of the grip body 91 have a cylindrical shape.

For example, the grip body 91 may be divided into an upper side and a lower side based on a given lateral partition line that intersects the grip body 91. The lower side may be a cylindrical shape, and the upper side may be a shape other than a cylindrical shape.

In the grip body 91 according to an embodiment of the present disclosure, a user's grasp stability can be improved by forming the upper side partially in a non-cylindrical shape suitable for being held.

The grip body 91 may be coupled to a seating unit 140 to be described later by forming the lower side partially in a cylindrical shape so that the grip body 91 is smoothly rotated.

The lower cover 93 may cover the lower opening part of the grip body 91 and may be formed in a hemispheric type.

The dryer 1 of the drying machine according to an embodiment of the present disclosure can prevent damage to the dryer 1 because the lower cover 93 is formed in a hemispheric type.

Specifically, if the stand 100 is not present, the dryer 1 is inevitably laid down because the grip 90 cannot stand upright with respect to the ground due to the hemispherical lower cover 93.

Accordingly, damage to the dryer 1 can be prevented, which may occur due to an impact occurring because the dryer 1 falls if the dryer 1 were able to stand upright.

However, the shape of the lower cover 93 is not limited to the above description and as shown in the drawing, and may include a range which can be easily designed and changed by those skilled in the art.

For example, the lower cover 93 may be a flat panel or pyramid shape, and not a hemispheric type.

Figure 3:
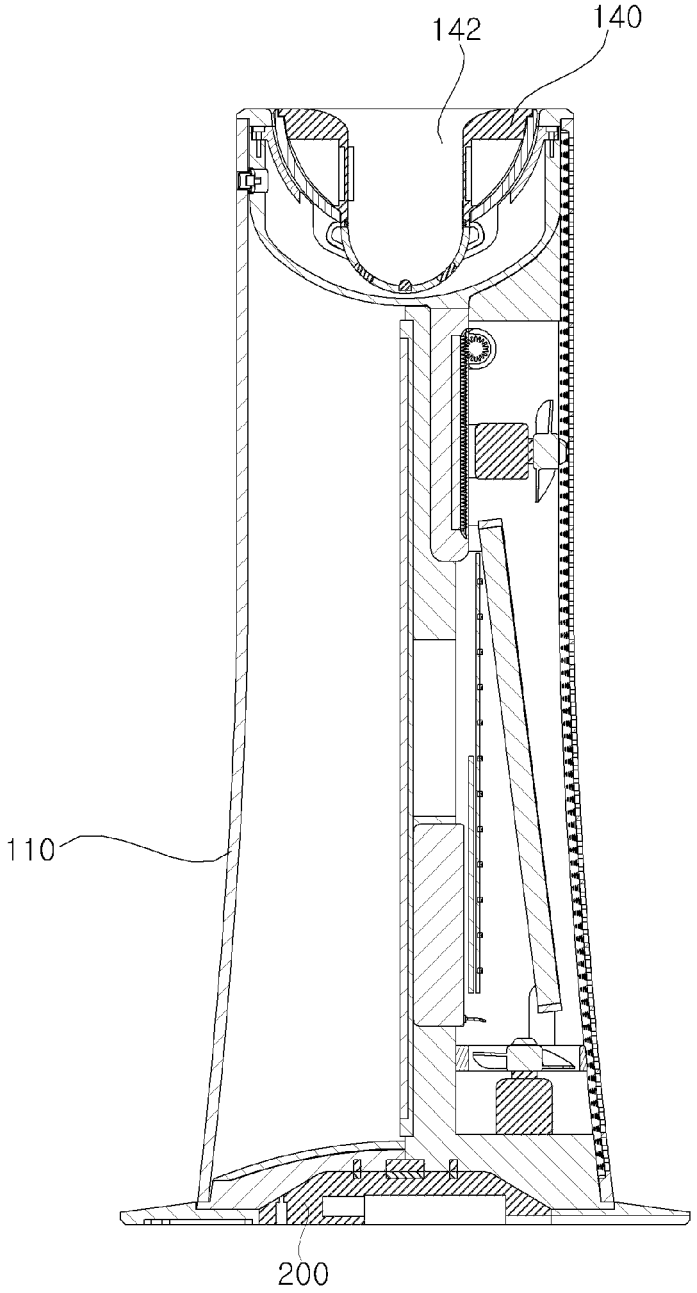
FIG. 3 is a cross-sectional view of a stand in which the dryer is to be seated according to an embodiment of the present disclosure.
Figure 4:
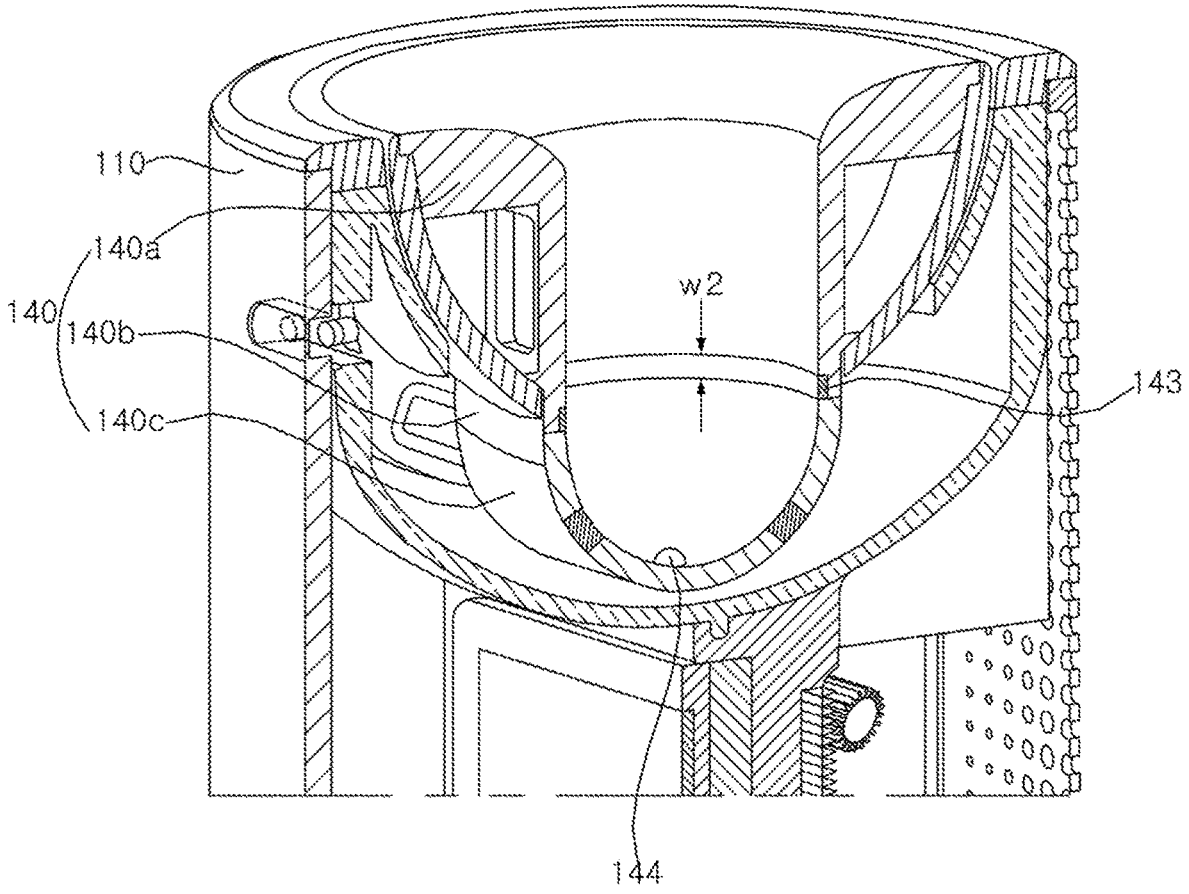
FIG. 4 is an enlarged cross-sectional view of the seating unit of the stand in which the dryer is to be seated according to an embodiment of the present disclosure.

The stand 100 in which the dryer 1 is held is described in detail with reference to FIGS. 3 and 4.

The stand 100 includes a barrel-shaped stand housing 110, a docking station 200 positioned in the lower opening of the stand housing 110, and a seating unit 140 positioned in an opening at the top of the stand housing 110.

The seating unit 140 includes a hollow portion 142 matched up with the grip 90.

At least part of the grip 90 is inserted into the top opening of the hollow portion 142, moves to the inside bottom surface of the hollow portion 142, and is then seated in the seating unit 140, so the dryer 1 is held in the stand 100.

In this specification, the hollow portion 142 matched up with the grip 90 means that the diameter of at least part of the hollow portion 142 is approximately the same as that of the grip 90, and thus the insertion structure can be firmly maintained without being shaken when the grip 90 is inserted into the hollow portion 142.

Specifically, the seating unit 140 may include a guide unit 140*a* having an opening formed therein in a ring shape.

Furthermore, the seating unit 140 may include a sidewall 140*b* having a cylindrical shape, which is extended downward from the inside edge of the guide unit 140*a*.

Furthermore, the seating unit 140 may include a bottom cover 140*c* covering the lower opening part of the sidewall 140*b*.

The guide unit 140*a*, the sidewall 140*b* and the bottom cover 140*c* may be integrated, but are not limited thereto, and may include a structure which can be easily designed and changed by those skilled in the art.

The hollow portion 142 of the seating unit 140 comprises an internal empty space formed by the guide unit 140*a*, the sidewall 140*b* and the bottom cover 140*c*.

Accordingly, at least part of the grip 90 may be inserted into the opening of the guide unit 140*a* and moves to the bottom cover 140*c*, so the grip 90 can be seated in the seating unit 140.

Furthermore, as described above, the portion of the grip body 91 that is inserted into the seating unit 140 has a cylindrical shape so that the dryer 1 is held in the seating unit 140.

In the seating unit 140, the guide unit 140*a* may be a ring shape, and a portion in which the circular opening of the guide unit 140*a* is formed may be a wide-opening form.

Specifically, the diameter of the opening of the guide unit 140*a* may be equal to or greater than that of the grip body 91, and may be increased from bottom to top, to flare out.

The opening formed within the guide unit 140*a* may have a wide-opening form structure gradually widened from bottom to top.

Accordingly, when the grip 90 of the dryer 1 is inserted into the seating unit 140, the grip 90 does not need to be accurately aligned with the opening of the guide unit 140*a*.

That is, if the grip 90 is inserted into the seating unit 140 within a given range based on the center of the opening of the guide unit 140*a*, the bottom of the grip 90 moves along the slope of the guide unit 140*a*. Accordingly, the dryer 1 can be easily held in the stand 100.

Furthermore, the opening of a wide-opening form is a circle and does not have directivity. Accordingly, the grip 90 can be easily inserted and held in the seating unit 140 in all directions without being limited to a specific direction and a specific angle.

As described above, in the drying machine according to an embodiment of the present disclosure, the dryer 1 can be easily held in the stand 100 by controlling the structure of the grip 90 and the structure of the seating unit 140.

Figure 5:
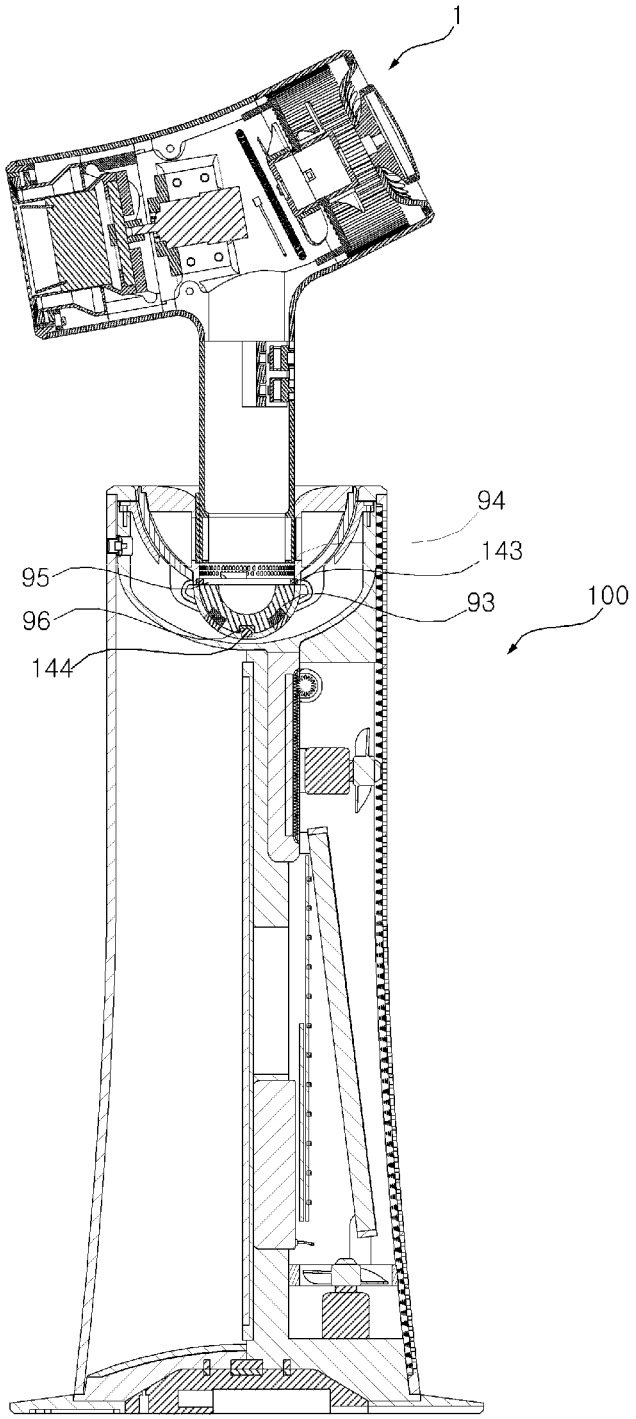
FIG. 5 is a cross-sectional view of a drying machine according to an embodiment of the present disclosure.

A structure in which the dryer 1 held in the stand 100 can be rotated stably and smoothly by controlling the structure of the grip 90 and the structure of the seating unit 140 is described with reference to FIGS. 4 and 5.

The insertion structure of the grip 90 inserted via the guide unit 140*a* may be supported by the sidewall 140*b*.

Specifically, the sidewall 140*b* has a cylindrical shape and corresponds to the shape of the grip body 91. The internal diameter of the sidewall 140*b* is basically identical with the external diameter of the grip body 91, so the sidewall 140*b* can firmly support the location of the grip body 91 in all directions.

Accordingly, the grip 90 inserted into the seating unit 140 can be rotated and can also stably maintain the rotation structure without being shaken or leaning to one side through the shape and diameter of the sidewall 140*b* and the grip body 91.

Furthermore, the height of the sidewall 140*b* may be two times or more the diameter of the grip body 91.

In the dryer 1, weighty elements (e.g., the fan 20) are intensively disposed in the upper portion of the casing 10 and are spaced apart from the center line of the grip 90 in a vertical direction.

Accordingly, when the dryer 1 is rotated, the dryer 1 may be detached from the stand 100 due to a centrifugal force. In the drying machine according to an embodiment of the present disclosure, however, the holding state can be maintained by stably supporting the grip 90 although a centrifugal force is applied because the height of the sidewall 140*b* is two times or more the diameter of the grip body 91.

Furthermore, the upper limit of the height of the sidewall 140*b* is smaller than the height of the grip body 91, and may be easily set by those skilled in the art within a range that does not hinder the dryer 1, held in the seating unit 140, from rotating.

The bottom cover 140*c* is matched up with the lower cover 93, and may have a hemispheric shape.

Accordingly, a part of the grip body 91 comes in contact with the sidewall 140*b*, and the lower cover 93 comes in contact with the bottom cover 140*c*.

A power transfer structure for transferring power to drive the fan 20 and heater H of the dryer 1 is described below with reference to FIGS. 2, 4 and 5.

External power is transmitted to the docking station 200 through an electric line. The docking station 200 is electrically connected to a first contact terminal 143 and a second contact terminal 144 included in the seating unit 140.

The grip 90 may include a first electrical terminal 95 and a second electrical terminal 96 for supplying power to the fan 20 and the heater H.

In the drying machine according to an embodiment of the present disclosure, the first electrical terminal 95 is electrically connected to the first contact terminal 143, and the second electrical terminal 96 is electrically connected to the second contact terminal 144, by simply inserting the grip 90 of the dryer 1 into the seating unit 140 in the stand 100.

Furthermore, in the drying machine according to an embodiment of the present disclosure, the electrical connection of the electrical terminals 95 and 96 and the contact terminals 143 and 144 can be maintained regardless of the rotation of the dryer 1 held in the stand 100, by configuring the first electrical terminal 95, the second electrical terminal 96, the first contact terminal 143 and the second contact terminal 144 to have a shape without directivity.

A detailed structure of the first electrical terminal 95, the second electrical terminal 96, the first contact terminal 143 and the second contact terminal 144 is described below.

The first electrical terminal 95 may be positioned in the grip body 91. The second electrical terminal 96 may be positioned in the lower cover 93.

Specifically, the first electrical terminal 95 may be positioned on the outer circumference surface of the grip body 91 and have a circular ring shape.

Furthermore, the first electrical terminal 95 may be flush with the outer circumference surface of the grip body 91. That is, a concave groove part matched up with the first electrical terminal 95 may be inwardly formed on the outer circumference surface of the grip body 91, and the first electrical terminal 95 may be positioned in the groove part.

Accordingly, insertion and detachment between the grip 90 and the seating unit 140 can be easily performed because a step is not formed between the first electrical terminal 95 and the outer circumference surface of the grip body 91.

The second electrical terminal 96 may be positioned at the center of the bottom of the lower cover 93, and may be inwardly concave. Furthermore, the lateral section of the second electrical terminal 96 may be circular.

For example, the second electrical terminal 96 may be positioned at the center of the bottom of the hemispheric lower cover 93, and may be a hemispheric, circular pyramid or cone shape concavely provided into the grip 90.

However, the shape of the second electrical terminal 96 is not limited to the above description and as shown in the drawing, and may include a structure which can be easily designed and changed by those skilled in the art within a range satisfying a condition in which the lateral section is a circle in a concave shape into the grip 90.

The first contact terminal 143 and the second contact terminal 144 may be positioned in the hollow portion 142 of the seating unit 140 in accordance with the first electrical terminal 95 and the second electrical terminal 96.

Specifically, the first contact terminal 143 is a circular ring shape, and may be positioned on the inner circumference surface of the sidewall 140*b* and parallel to the ground in accordance with the configuration of the first electrical terminal 95.

In this specification, the meaning that the contact terminal is positioned in accordance with the electrical terminal means that the contact terminal is positioned so that the grip 90 can come in contact with the electrical terminal of the grip 90 when the grip 90 is fully inserted and seated in the seating unit 140.

Furthermore, the first contact terminal 143 may be flush along with the inner circumference surface of the sidewall 140*b*. That is, a concave groove part matched up with the first contact terminal 143 may be inwardly formed on the inner circumference surface of the sidewall 140*b*. The first contact terminal 143 may be positioned in the groove part.

Accordingly, insertion and detachment between the grip 90 and the seating unit 140 can be easily performed because the first contact terminal 143 and the inner circumference surface of the sidewall 140*b* do not form a step.

The second contact terminal 144 may be positioned at the top of the bottom cover 140*c* in accordance with the configuration of the second electrical terminal 96, and may be upwardly convex in such a way as to be matched up with the second electrical terminal 96.

Specifically, the lateral section of the second contact terminal 144 is a circle, and may be a hemispheric, circular pyramid or cone shape, and may correspond to the shape of the second electrical terminal 96.

In the drying machine according to an embodiment of the present disclosure, the electrical terminals 95 and 96 and the contact terminals 143 and 144 can be electrically connected stably although the dryer 1 is rotated by controlling the shapes of the electrical terminals 95 and 96 of the grip 90 and the contact terminals 143 and 144 of the seating unit 140.

Specifically, the first electrical terminal 95 and the first contact terminal 143 are positioned on the outer circumference surface of the grip body 91 and the inner circumference surface of the sidewall 140*b*, respectively, so that they correspond to each other in a circular ring shape. The diameter of the grip body 91 is identical with the diameter of the sidewall 140*b*.

Accordingly, the electrical connection can be stably maintained regardless of the location or direction of the dryer 1 because at least part of the first electrical terminal 95 always comes in contact with at least part of the first contact terminal 143 even though the dryer 1 may be rotated.

Furthermore, the second electrical terminal 96 and the second contact terminal 144 have a concave shape and a convex shape, respectively, so that they are matched up with each other, and each of the second electrical terminal 96 and the second contact terminal 144 has a circular lateral section.

Accordingly, although the dryer 1 is rotated, the second electrical terminal 96 and the second contact terminal 144 can be coupled and always electrically connected if the dryer 1 is fully seated in the seating unit 140.

Furthermore, the lower cover 93 in which the second electrical terminal 96 is positioned may have a downwardly convex hemispheric type. The bottom cover 140*c* in which the second contact terminal 144 is positioned may have a hemispheric concavity into the stand 100 so that it is matched up with the lower cover 93.

Proper weight pressure is applied to the second electrical terminal 96 because the lower cover 93 has a hemispheric shape, and the second electrical terminal 96 is positioned at the center of the bottom of the lower cover 93. Accordingly, the coupling structure with the second contact terminal 144 can be easily maintained.

Furthermore, the hemispheric lower cover 93 distributes the weight pressure of the dryer 1 around the second electrical terminal 96. Accordingly, damage attributable to rotation or detachment can be prevented because weight pressure is concentrated on the second electrical terminal 96 and the second contact terminal 144.

The width W1 of the first electrical terminal 95 may be different from the width W2 of the first contact terminal 143. For example, the width W1 of the first electrical terminal 95 may be greater than the width W2 of the first contact terminal 143.

Although the grip 90 in use may move slightly up or down or left or right in the seating unit 140, the first electrical terminal 95 and the first contact terminal 143 can stably maintain their electrical connection due to a difference between the width W1 of the first electrical terminal 95 and the width W2 of the first contact terminal 143.

Furthermore, although the grip 90 leans to the left or right slightly due to rotation, the grip 90 precisely seated in the seating unit 140 does not move to the outside because the upper and lower sides of the sidewall 140*b* function as trapping portions. Accordingly, the first and second electrical terminals 95 and 96 and the first and second contact terminals 143 and 144 can stably maintain their contacts.

Additionally, as described above, the electrical terminals 95 and 96 of the grip 90 and the contact terminals 143 and 144 of the seating unit 140 have shapes without directivity.

Accordingly, when the dryer 1 is held in the stand 100, power can be supplied from the stand 100 to the dryer 1 because the electrical connection is stably maintained although the grip 90 is inserted and held in the seating unit 140 in one direction and one angle regardless of a specific direction and a specific angle.

Figure 6:
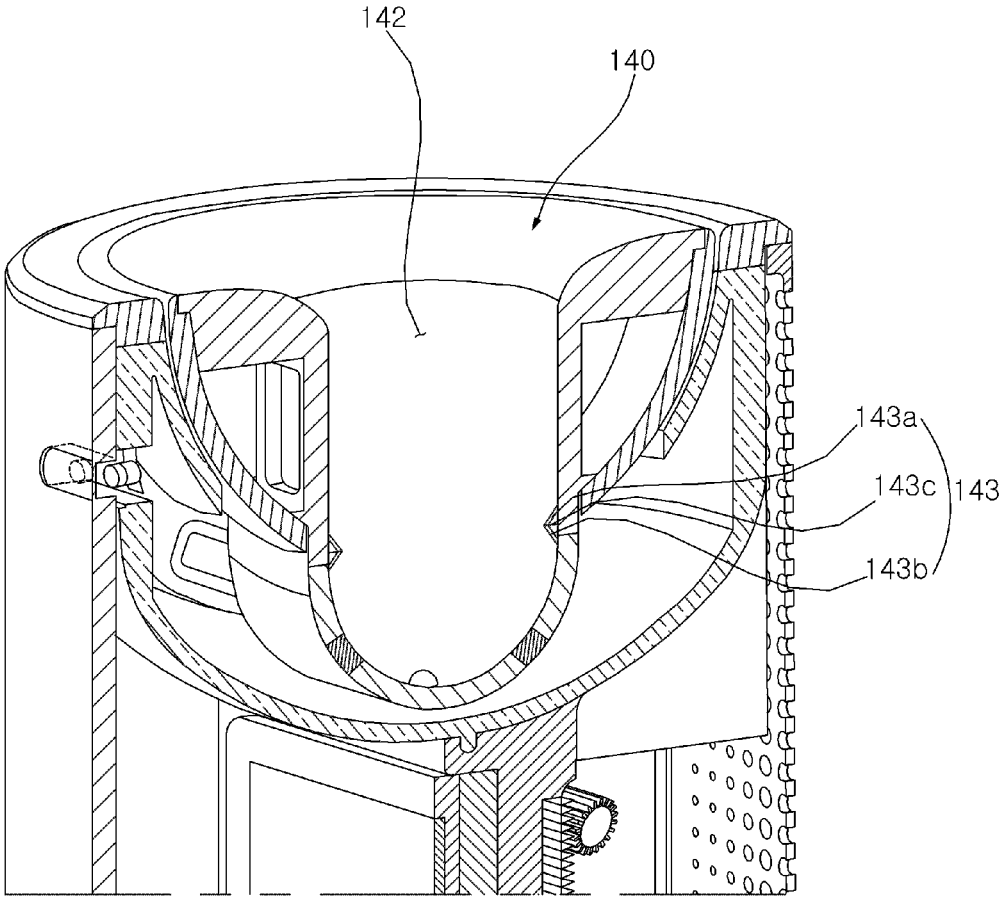
FIG. 6 is an enlarged cross-sectional view of the seating unit according to another embodiment of the present disclosure.

A drying machine according to another embodiment of the present disclosure is described below with reference to FIG. 6.

The drying machine according to the present embodiment is substantially the same as the drying machine described with reference to FIGS. 1 to 5 except for changes to the contact terminal. Accordingly, a repeated description is omitted and a difference is mainly described.

In the drying machine according to another embodiment of the present disclosure, the seating unit 140 includes a first contact terminal 143 extended and protruded into the hollow portion 142 from the inner side of the hollow portion 142, and a second contact terminal 144 positioned at the center of the inside bottom surface (i.e., the bottom cover 140*c*) of the hollow portion 142 and convex upward.

Specifically, the first contact terminal 143 may include at least one first protruded electrode 143*a* extended in a first direction that forms an acute angle with the inner side of the sidewall 140*b* on the inner side of the sidewall 140*b*.

In this specification, the first direction forming an acute angle with the inner side of the sidewall 140*b* means that an included angle between an orthogonally projected line and the first direction is an acute angle when the first direction is orthogonally projected onto the inner side of the sidewall 140*b* in the given first direction that intersects the inner side of the sidewall 140*b* through the sidewall 140*b*.

Furthermore, the first contact terminal 143 may include a second protruded electrode 143*b* extended from one end of the first protruded electrode 143*a* toward the inner side of the sidewall 140*b* in a second direction that forms an acute angle with the inner side of the sidewall 140*b*.

However, acute angles between the inner side of the sidewall 140*b* and the first protruded electrode 143*a* and the second protruded electrode 143*b* may be the same or different.

Furthermore, the acute angle may be less than 45°. If the acute angle exceeds 45°, the first contact terminal 143 may be bent and permanently deformed when the grip 90 is inserted or detached from the seating unit 140.

The first contact terminal 143 may form a curved part 143*c* where the first protruded electrode 143*a* and the second protruded electrode 143*b* are connected.

The curved part 143*c* may be a portion coming in contact with the first electrical terminal 95 having a circular ring shape when the grip 90 is inserted into the seating unit 140.

Specifically, the first contact terminal 143 includes a conductive material having shape elasticity. The first protruded electrode 143*a* and the second protruded electrode 143*b* may be longitudinally disposed in parallel in the direction in which the grip 90 is inserted.

However, the arrangement direction of the first contact terminal 143 is not limited to the above description and as shown in the drawing, and may include a range which can be easily changed by those skilled in the art.

For example, the first protruded electrode 143*a* and second protruded electrode 143*b* of the first contact terminal 143 may be transversely disposed to be perpendicular to the insertion direction of the grip 90. A structure in which the first contact terminal 143 is positioned longitudinally is assumed and described below.

When the grip 90 is inserted into the hollow portion 142 of the seating unit 140, the first contact terminal 143 may be deformed so that the curved part 143*c* becomes close to the inner side of the sidewall 140*b* in the state in which the curved part 143*c* has come in contact with the outer side of the grip 90 because the diameter of the grip body 91 is the same as that of the hollow portion 142.

The curved part 143*c* comes in contact with at least part of the first electrical terminal 95 by the shape elasticity force of the first contact terminal 143 in the state in which the grip 90 has been fully inserted.

Accordingly, although the dryer 1 is rotated, the first electrical terminal 95 and the curved part 143*c* can be electrically connected because the contact state of the first electrical terminal 95 having a circular ring shape and the curved part 143*c* is maintained.

For reference, the grip 90 can be easily inserted into the seating unit 140 although the grip 90 having the same diameter as the hollow portion 142 is inserted into the seating unit 140 because the thickness of the first contact terminal 143 is relatively very small compared to the diameter of the grip 90 and the seating unit 140.

If the grip 90 is detached from the seating unit 140, the pressed first contact terminal 143 may return to its original state due to the shape elasticity.

Additionally, the first contact terminal 143 may be a line shape having a given width, but the structure thereof is not limited to the above description and as shown in the drawing, and may include a structure which can be easily designed and changed by those skilled in the art.

Figure 7:
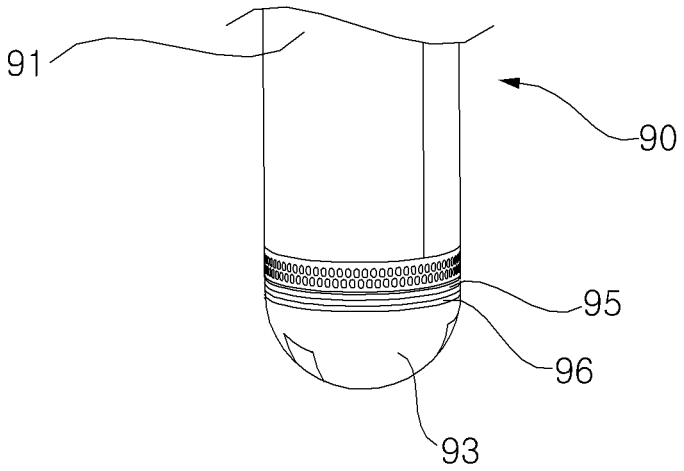
FIG. 7 is a cross-sectional view showing the coupling of a grip and a seating unit according to another embodiment of the present disclosure.
Figure 7:
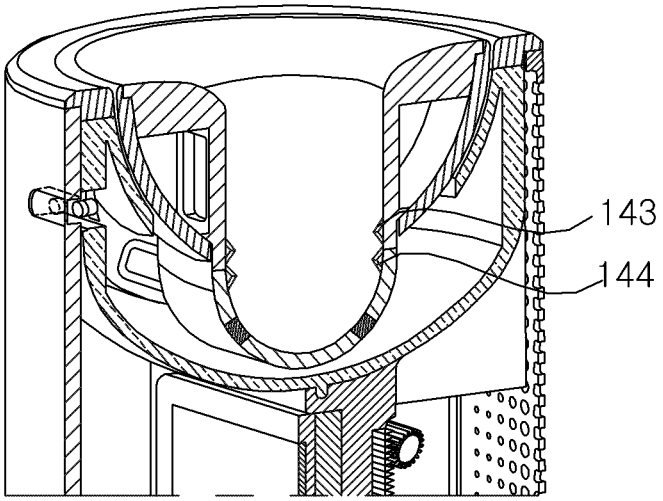

A drying machine according to another embodiment of the present disclosure is described below with reference to FIG. 7.

The drying machine according to the present embodiment is substantially the same as the drying machine described with reference to FIG. 6 except for changes to the second electrical terminal 96 and the second contact terminal 144. Accordingly, a repeated description is omitted and a difference is mainly described.

A grip 90 according to the present embodiment includes a second electrical terminal 96 spaced apart from a first electrical terminal 95, parallel to the first electrical terminal 95 in a circular ring shape, and positioned on the outer circumference surface of the grip body 91.

A seating unit 140 according to the present embodiment includes the second contact terminal 144 having the same shape as the first contact terminal 143, spaced apart from the first contact terminal 143, and positioned on the inner side (i.e., the inner side of the sidewall 140*b*) of the hollow portion 142.

When the grip 90 is inserted into the hollow portion 142 of the seating unit 140, the first and second contact terminals 143 and 144 may be deformed so that the curved part 143*c* of the first contact terminal 143 and a curved part of the second contact terminal 144 become close to the inner side of the sidewall 140*b* in the state in which the curved part 143*c* of the first contact terminal 143 and the curved part of the second contact terminal 144 have come in contact with the outer side of the grip 90 because the diameter of the grip body 91 is the same as that of the hollow portion 142.

The curved part 143*c* of the first contact terminal 143 and the curved part of the second contact terminal 144 come in contact with at least parts of the first electrical terminal 95 and the second electrical terminal 96, respectively, due to the shape elasticity force of the first and second contact terminals 143 and 144 in the state in which the grip 90 has been fully inserted into the hollow portion 142.

Accordingly, although the dryer 1 is rotated, the first and second electrical terminals 95 and 96 having a circular ring shape and the curved parts of the first and second contact terminals 143 and 144 can be electrically connected because the contact state between them is maintained.

If the grip 90 is detached from the seating unit 140, the pressed first and second contact terminals 143 and 144 may return to their original state by shape elasticity.

The locations of the first contact terminal 143 and the second contact terminal 144 may include a range which can be easily designed and changed by those skilled in the art if the locations have a structure in which the first contact terminal 143 and the second contact terminal 144 are spaced apart from each other and satisfy locations corresponding to the first electrical terminal 95 and the second electrical terminal 96.

Figure 8:
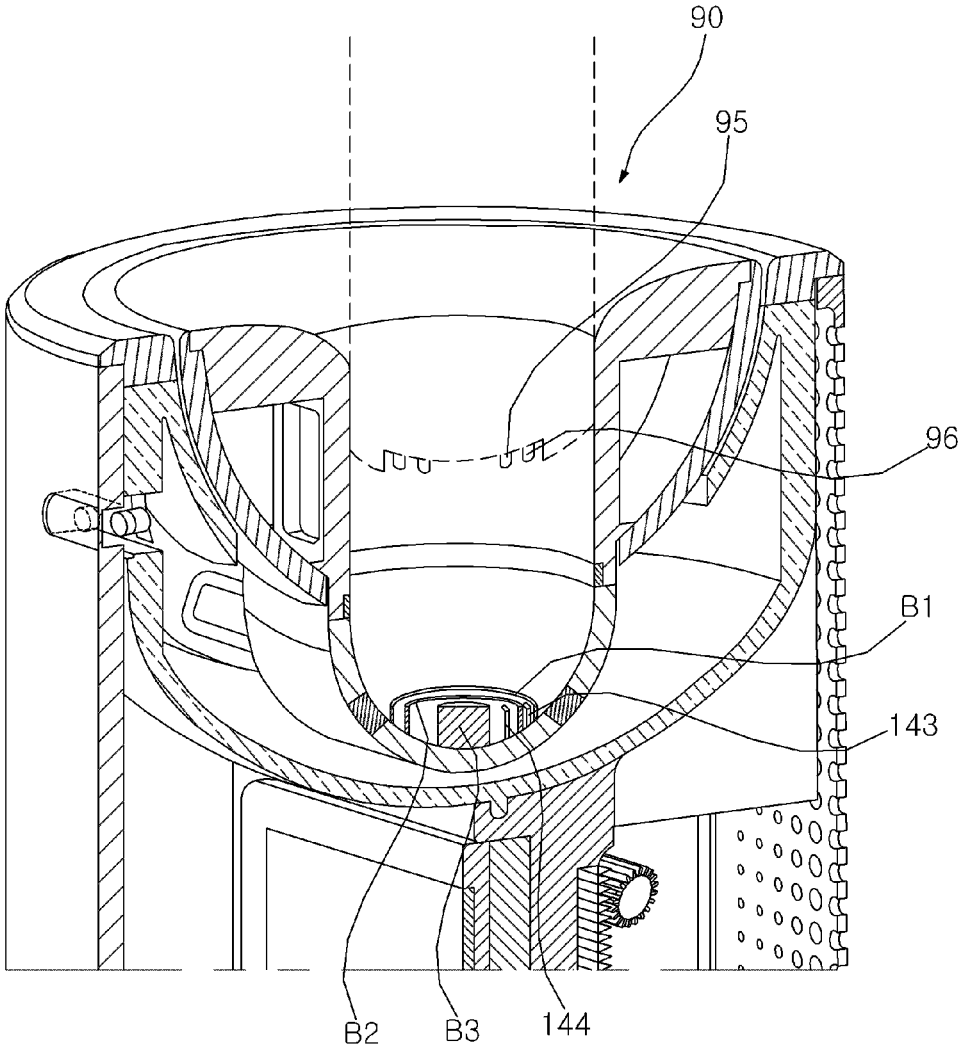
FIG. 8 is a cross-sectional view showing the coupling of a grip and a seating unit according to another embodiment of the present disclosure.

A drying machine according to another embodiment of the present disclosure is described below with reference to FIG. 8.

The drying machine according to the present embodiment is substantially the same as the drying machine described with reference to FIGS. 1 to 5 except for the shapes and arrangement structure of the first electrical terminal 95 and the second electrical terminal 96 and the shapes and arrangement structure of the first contact terminal 143 and the second contact terminal 144. Accordingly, a repeated description is omitted and a difference is mainly described.

In the drying machine according to the present embodiment, a grip 90 includes a first electrical terminal 95 having a circular ring shape positioned at the bottom of the lower cover 93.

Furthermore, the grip 90 includes a second electrical terminal 96 having a circular ring shape, which is spaced apart from the first electrical terminal 95 at the bottom of the lower cover 93 and surrounds the first electrical terminal 95.

The seating unit 140 includes a first contact terminal 143 and a second contact terminal 144 which are upward extended and protruded from the inside bottom surface of the hollow portion 142.

Specifically, the bottom cover 140*c* may include a cylindrical first barrier B1 having its center open, a cylindrical second barrier B2 formed within the first barrier B1 and having its center open, and a cylindrical third barrier B3 formed within the second barrier B2.

The seating unit 140 may include the linear first contact terminal 143 upward extended from the bottom cover 140*c* between the first barrier B1 and the second barrier B2.

Furthermore, the seating unit 140 may include the linear second contact terminal 144 upward extended from the bottom cover 140*c* between the second barrier B2 and the third barrier B3.

As described above, the first contact terminal 143 and the second contact terminal 144 may come in contact with at least part of the first electrical terminal 95 and the second electrical terminal 96, and thus may be electrically connected thereto.

Specifically, when the grip 90 is fully inserted into the seating unit 140, the first electrical terminal 95 may be positioned at a location corresponding to the first contact terminal 143, and the second electrical terminal 96 may be positioned at a location corresponding to the second contact terminal 144, so the first electrical terminal 95 and the first contact terminal 143 may come in contact with each other, and the second electrical terminal 96 and the second contact terminal 144 may come in contact with each other.

Each of the first contact terminal 143 and the second contact terminal 144 may have a curved line form, including a curved part corresponding in shape to the first and second electrical terminals 95 and 96.

Accordingly, in a process of inserting or detaching the grip 90 and the seating unit 140, the first contact terminal 143 and the second contact terminal 144 can be prevented from being permanently deformed and damaged although the first electrical terminal 95 and the second electrical terminal 96 repeatedly apply an impact to one ends of the first contact terminal 143 and the second contact terminal 144.

Although an impact is delivered to one end of the curved line form including the curved part, both ends of the curved line form are fold based on the curved part, deformed and return to the original shape by shape elasticity. This may be advantageous for the durability of the first and second contact terminals 143 and 144.

The first to third barriers B1, B2, and B3 physically separately the first contact terminal 143 and the second contact terminal 144 and also maintain a given height from the bottom cover 140*c*. Accordingly, the first and second contact terminals 143 and 144 can be prevented from being permanently deformed by an excessive impact applied thereto.

Figure 9:
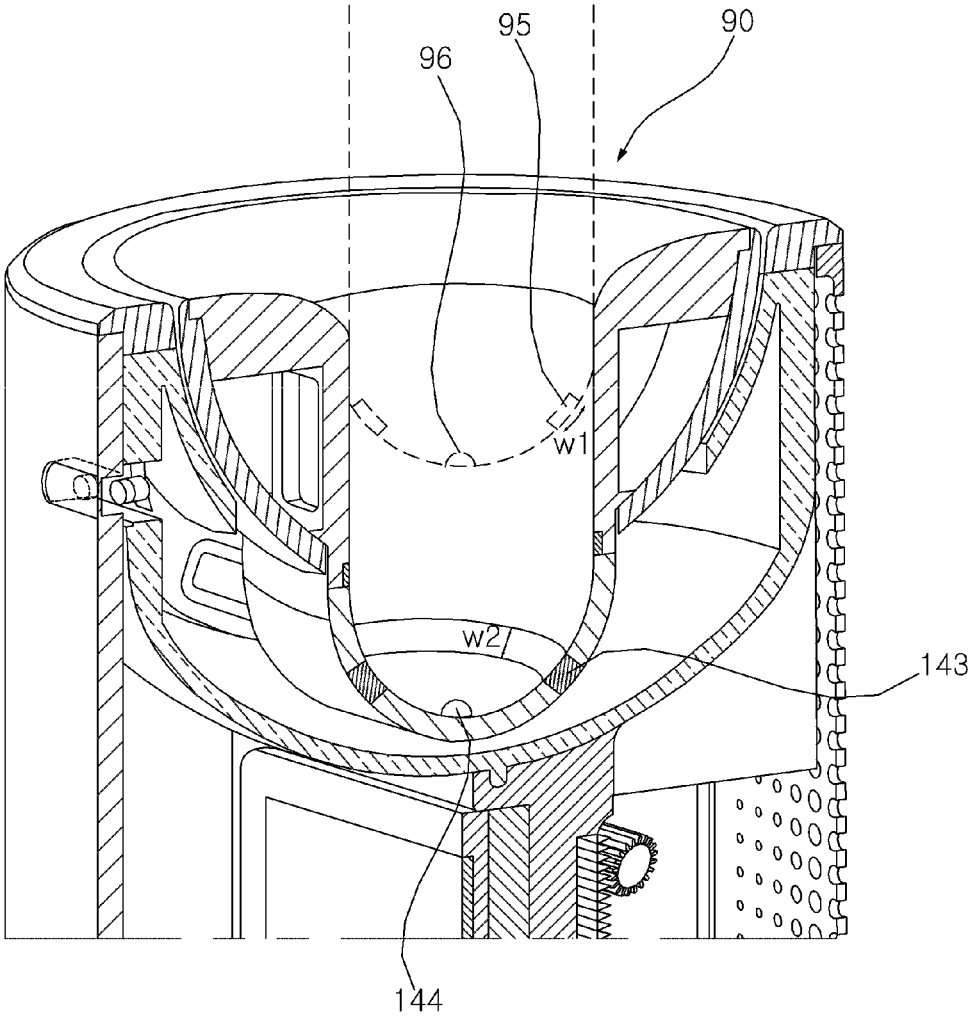
FIG. 9 is a cross-sectional view showing the coupling of a grip and a seating unit according to another embodiment of the present disclosure.

A drying machine according to another embodiment of the present disclosure is described with reference to FIG. 9.

The drying machine according to the present embodiment is substantially the same as the drying machine described with reference to FIGS. 1 to 5 except for the shape and arrangement structure of the first electrical terminal 95 and the shape and arrangement structure of the first contact terminal 143. Accordingly, a repeated description is omitted and a difference is mainly described.

Specifically, the first electrical terminal 95 is spaced apart from the second electrical terminal 96 and not on the grip body 91, and may be positioned at the bottom of the lower cover 93 in a circular ring shape.

The first contact terminal 143 is spaced apart from the second contact terminal 144 and not on the sidewall 140*b*, and may be positioned at the top of the bottom cover 140*c* in a circular ring shape.

If the first contact terminal 143 is positioned in accordance with the first electrical terminal 95 and the grip 90 is fully inserted into the seating unit 140, the first contact terminal 143 and the first electrical terminal 95 may be electrically connected.

Specifically, the first electrical terminal 95 may be positioned on a curved surface at the bottom of the hemispheric lower cover 93.

The first contact terminal 143 may be positioned on a curved surface at the top of the hemispheric bottom cover 140*c*.

A surface of the first electrical terminal 95 has the same curvature as the lower cover 93 because the first electrical terminal 95 may be positioned on the curved surface.

Accordingly, the first contact terminal 143 has the same curvature as the top of the bottom cover 140*c*, and can implement a structurally closed coupling shape and stably maintain an electrical connection.

Furthermore, the width W2 of the first contact terminal 143 may be smaller than the width W1 of the first electrical terminal 95.

In the rotation process of the dryer 1, the first electrical terminal 95 and the first contact terminal 143 can maintain an electrical connection stably although the lower cover 93 moves right and left slightly in the bottom cover 140*c* due to a difference between the width W1 of the first electrical terminal 95 and the width W2 of the first contact terminal 143.

The dryer 1 of the present disclosure has one or more of the following effects.

First, the drying machine according to an embodiment of the present disclosure includes the grip 90 having a cylindrical shape and the hollow portion 142 matched up with the grip 90.

Accordingly, effective drying can be performed for a long time without fatigue of the human body because the state in which the dryer 1 has been held in the stand 100 can be stably maintained, and the dryer 1 held in the stand 100 can be smoothly rotated.

Second, the drying machine according to an embodiment of the present disclosure includes the electrical terminals and the contact terminals formed in a shape not having directivity so that an electrical connection between the electrical terminals of the dryer 1 and the contact terminals of the seating unit 140 is maintained even if the dryer 1 is rotated in the stand 100.

Accordingly, power can be stably supplied to the dryer 1 although the dryer 1 is rotated in the state in which the dryer 1 has been held in the stand 100.

Third, in the drying machine according to an embodiment of the present disclosure, the hollow portion 142 into which the grip 90 is inserted has a wide-opening form, and has no directivity for the grip 90, the electrical terminals 95 and 96 and the contact terminals 143 and 144.

Accordingly, the dryer 1 can be easily held in the stand 100, and the dryer 1 can be charged by the stand 100 although the dryer 1 is held in the stand 100 in any direction or at any angle.

Effects of the present disclosure are not limited to the above-described effects, and other effects not described above may be evidently understood by those skilled in the art from the claims.

What is claimed is:

1. A drying machine, comprising:

a dryer, the dryer including:

a casing having a front opening;

a grip extending from a side of the casing, the grip including a grip body configured to be grasped by a hand of a user of the dryer, the grip further including a first electrical terminal and a second electrical terminal; and a lower cover covering a lower opening part of the grip body; and a stand, the stand including:

a seat in which the dryer is rotatably receivable, the seat including a hollow portion configured to receive the grip therein, the seat further including a first contact terminal located in the hollow portion and a second contact terminal located in the hollow portion, wherein the first electrical terminal is electrically connected to the first contact terminal when the grip is located in the hollow portion, wherein the second electrical terminal is electrically connected to the second contact terminal when the grip is located in the hollow portion, and wherein the first and second electrical terminals maintain an electrical connection with the first and second contact terminals, respectively, regardless of a rotational position of the dryer with respect to the seat when the grip is located in the hollow portion.

2. The drying machine of claim 1, wherein the stand further comprises a barrel-shaped stand housing supporting the seat, and wherein a depth of the hollow portion of the seat is more than twice a width of the hollow portion to stably support the grip within the hollow portion.

3. The drying machine of claim 1, wherein the first electrical terminal is located in the grip body, wherein the second electrical terminal is located in the lower cover, wherein the seat comprises:

a guide located at an upper portion of the seat, the guide having a ring-shaped opening located therein;

a cylindrical sidewall extending downward from an inside edge of the guide; and a bottom cover covering a lower opening part of the sidewall, and wherein the grip is inserted into the hollow portion of the seat through the opening.

4. The drying machine of claim 3, wherein an internal diameter of the sidewall is the same as an external diameter of the grip body.

5. The drying machine of claim 4, wherein a diameter of the opening of the guide is greater than the internal diameter of the sidewall, and wherein the diameter of the opening increases from a lower portion of the guide to an upper portion of the guide.

6. The drying machine of claim 3, wherein the first electrical terminal is located on an outer circumference surface of the grip body, the first electrical terminal being ring shaped, and wherein the second electrical terminal is located in a center portion of a bottom of the lower cover, the second electrical terminal being concave inward and having a circular lateral cross-section.

7. The drying machine of claim 6, wherein the first contact terminal is located on an inner circumference surface of the sidewall at a position corresponding to a position of the first electrical terminal, the first contact terminal being ring shaped, and wherein the second contact terminal is located on a center portion of the bottom cover at a position corresponding to a position of the second electrical terminal, the second contact terminal being convex upward to couple with the second electrical terminal.

8. The drying machine of claim 3, wherein the lower cover has a hemispheric shape that is downwardly convex, wherein the bottom cover has a hemispheric shape that is upwardly concave, and wherein the lower cover is receivable within the bottom cover.

9. The drying machine of claim 1, wherein the first electrical terminal is located on an outer circumference surface of the grip body, the first electrical terminal being ring shaped, wherein the second electrical terminal is located in a center portion of a bottom of the lower cover, the second electrical terminal being concave inward, wherein the first contact terminal is extended from an inner side of the hollow portion and protruded into the hollow portion at a position corresponding to a position of the first electrical terminal, and wherein the second contact terminal is located at a center portion of an inside bottom surface of the hollow portion at a position corresponding to a position of the second electrical terminal, the second contact terminal being convex upward to couple with the second electrical terminal.

10. The drying machine of claim 9, wherein the seat comprises:

a guide located at an upper portion of the seat, the guide having a ring-shaped opening located therein;

a cylindrical sidewall extending downward from an inside edge of the guide; and a bottom cover covering a lower opening part of the sidewall, and wherein the grip is inserted into the hollow portion of the seat through the opening.

11. The drying machine of claim 10, wherein the first contact terminal comprises:

a first protruded electrode extended from an inner side of the sidewall in a first direction forming an acute angle with the inner side of the sidewall, and a second protruded electrode extended from one end of the first protruded electrode toward the inner side of the sidewall in a second direction forming an acute angle with the inner side of the sidewall.

12. The drying machine of claim 11, wherein the first contact terminal comprises a conductive material having shape elasticity.

13. The drying machine of claim 10, wherein the second contact terminal is located at a center portion of the bottom cover, and wherein the second contact terminal has a circular lateral cross-section.

14. The drying machine of claim 1, wherein the first electrical terminal is located on an outer circumference surface of the grip body, the first electrical terminal being ring shaped, wherein the second electrical terminal is located on the outer circumference surface of the grip body, the second electrical terminal being ring shaped, the second electrical terminal being parallel to and spaced apart from the first electrical terminal, wherein the first contact terminal is extended from an inner side of the hollow portion and protruded into the hollow portion at a position corresponding to a position of the first electrical terminal, and wherein the second contact terminal is extended from the inner side of the hollow portion and protruded into the hollow portion at a position spaced apart from the first contact terminal and corresponding to a position of the second electrical terminal.

15. The drying machine of claim 14, wherein the seat comprises:

a guide located at an upper portion of the seat, the guide having a ring-shaped opening located therein;

a cylindrical sidewall extending downward from an inside edge of the guide; and a bottom cover covering a lower opening part of the sidewall, and wherein the grip is inserted into the hollow portion of the seat through the opening.

16. The drying machine of claim 15, wherein each of the first contact terminal and the second contact terminal comprises:

a first protruded electrode extended from an inner side of the sidewall in a first direction forming an acute angle with the inner side of the sidewall, and a second protruded electrode extended from one end of the first protruded electrode toward the inner side of the sidewall in a second direction forming an acute angle with the inner side of the sidewall.

17. The drying machine of claim 1, wherein the first electrical terminal is located at a bottom of the lower cover, the first electrical terminal having a circular ring shape, wherein the second electrical terminal is located at the bottom of the lower cover, the second electrical terminal having a circular ring shape, the second electrical terminal being spaced apart from the first electrical terminal and configured to surround the first electrical terminal, wherein the first contact terminal extends upwardly from an inside bottom surface of the hollow portion and protrudes into the hollow portion, and wherein the second contact terminal extends upwardly from the inside bottom surface of the hollow portion and protrudes into the hollow portion.

18. The drying machine of claim 17, wherein each of the first contact terminal and the second contact terminal comprises a curved portion extended upwardly from the inside bottom surface of the hollow portion, wherein the first contact terminal is located at a position corresponding to a position of at least part of the first electrical terminal, and wherein the second contact terminal is located at a position corresponding to a position of at least part of the second electrical terminal.

19. The drying machine of claim 17, wherein the seat comprises:

a cylindrical first barrier located on the inside bottom surface of the hollow portion; and a cylindrical second barrier located on the inside bottom surface of the hollow portion and within the first barrier, wherein the first contact terminal is located within the second barrier, and wherein the second contact terminal is located between the first barrier and the second barrier.

20. The drying machine of claim 1, wherein the lower cover has a hemispheric shape that is downwardly convex, wherein the first electrical terminal is located on a lower portion of the lower cover, the first electrical terminal being ring shaped, wherein the second electrical terminal is located in a center portion of a bottom of the lower cover, the second electrical terminal being concave inward and having a circular lateral cross-section, wherein the first contact terminal is located on an inner surface of the hollow portion at a position corresponding to a position of the first electrical terminal, the first contact terminal being ring shaped, and wherein the second contact terminal is located on a center portion of the inner surface of the hollow portion at a position corresponding to a position of the second electrical terminal, the second contact terminal being convex upward to couple with the second electrical terminal.

* * * * *